US007255470B2

(12) United States Patent
Lee et al.

(10) Patent No.: US 7,255,470 B2
(45) Date of Patent: Aug. 14, 2007

(54) LAMP FIXING HOLDER AND BACK LIGHT ASSEMBLY HAVING THE SAME

(75) Inventors: Jeong-Hwan Lee, Suwon-si (KR); Jong-Dae Park, Seoul (KR); Young-Il Kim, Yongin-si (KR); Chang-Young Bang, Suwon-si (KR); Tae-Jin Lee, Suwon-si (KR); Yong-Seok Choi, Suwon-si (KR); Jae-Ho Jung, Yongin-si (KR); Keun-Woo Lee, Gyeonggi-do (KR); Jae-Sang Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 70 days.

(21) Appl. No.: 10/519,582

(22) PCT Filed: Jun. 23, 2003

(86) PCT No.: PCT/KR03/01223

§ 371 (c)(1),
(2), (4) Date: Dec. 22, 2004

(87) PCT Pub. No.: WO04/001282

PCT Pub. Date: Dec. 31, 2003

(65) Prior Publication Data

US 2005/0248936 A1 Nov. 10, 2005

(30) Foreign Application Priority Data

Jun. 25, 2002 (KR) ..... 10-2002-0035717

(51) Int. Cl.
*F21V 21/08* (2006.01)

(52) U.S. Cl. ..... 362/614; 362/613; 362/219

(58) Field of Classification Search ..... 362/249, 362/396, 426, 430, 452, 457, 561, 611, 613, 362/614, 225, 219

See application file for complete search history.

(56) References Cited

U.S. PATENT DOCUMENTS

| | | | | |
|---|---|---|---|---|
| 4,826,294 | A | 5/1989 | Imoto | |
| 5,664,873 | A * | 9/1997 | Kanda et al. | 362/97 |
| 6,412,971 | B1 * | 7/2002 | Wojnarowski et al. | 362/249 |
| 6,502,968 | B1 * | 1/2003 | Simon | 362/489 |
| 6,666,567 | B1 * | 12/2003 | Feldman et al. | 362/237 |
| 6,966,664 | B2 * | 11/2005 | Wu | 362/610 |

FOREIGN PATENT DOCUMENTS

| | | |
|---|---|---|
| DE | 19929792 A1 | 2/2000 |
| EP | 0455887 A2 | 11/1991 |
| JP | 2001-066589 | 3/2001 |
| JP | 2001-210126 | 8/2001 |

OTHER PUBLICATIONS

Patent Abstracts of Japan, No. 2001-066589, Mar. 16, 2001.
Patent Abstracts of Japan, No. 2001-210126, Aug. 3, 2001.

* cited by examiner

*Primary Examiner*—Laura Tso
(74) *Attorney, Agent, or Firm*—MacPherson Kwok Chen & Heid LLP; Brent A. Folsom

(57) ABSTRACT

There is provided a lamp fixing holder. A lamp fixing holder for fixes a lamp to a receiving container. The lamp provides a liquid crystal display panel with light. The lamp includes a first portion of a face and a second portion of the face. The light emitted from the first portion of the face advances toward the liquid crystal display panel. The lamp fixing holder comprises a lamp fixing body and a fixing member. The lamp fixing body holds a third portion of the face of the lamp. The second portion includes the third portion. The fixing member fixes the lamp fixing body to the receiving container. The lamp fixing holder according to the present invention fixes the lamp so that the lamp does not sway, while minimizing an amount of light that is shielded by the lamp fixing holder.

16 Claims, 13 Drawing Sheets

LAMP FIXING HOLDER AND BACK LIGHT ASSEMBLY HAVING THE SAME

TECHNICAL FIELD

This disclosure relates to a lamp fixing holder and a back light assembly having the lamp fixing holder, and more particularly to a lamp fixing holder for minimizing the light loss and a back light assembly having the same.

BACKGROUND ART

Users perceive an image-information processed by an information-processing device through the display device.

A liquid crystal display (LCD) device, which is one of the display devices, displays an image-information using liquid crystal of which transmissivity is changed according to the electric field applied the liquid crystal.

The liquid crystal regulates only the transmissivity. Therefore, a light source is needed so as to display an image.

A lamp is used as a light source. For example, a cold cathode fluorescent lamp (CCFL) is used as a lamp for supplying a liquid crystal display panel of the liquid crystal display device with light.

The cold cathode fluorescent lamp has many merits. For example, the cold cathode fluorescent lamp may have a cylindrical shape having a small diameter. The cold cathode fluorescent lamp generates white light that is similar to the solar light. The cold cathode fluorescent lamp has a long life span. The cold cathode fluorescent lamp generates a small amount of heat.

The cold cathode fluorescent lamp may be arranged variously according to a size of the liquid crystal display device.

In a small sized or in a middle sized liquid crystal display device, one or two cold cathode fluorescent lamps may be disposed adjacent to the side of a light guide plate (LGP), because one or two cold cathode fluorescent lamps provide the liquid crystal display panel with enough light to display an image. The liquid crystal display device described above is referred to as an edge-illumination type liquid crystal display device.

Comparatively, in a large sized liquid crystal display device, more than three cold cathode fluorescent lamps are needed so as to provide the liquid crystal display panel with enough light. In a large sized liquid crystal display device, cold cathode fluorescent lamps are arranged parallel with each other. The cold cathode fluorescent lamps are disposed under the liquid crystal display panel so as to apply light to the liquid crystal display panel. This liquid crystal display device is referred to as a direct-illumination type liquid crystal display device.

Nowadays, a size of a display panel becomes larger. Therefore, a length of the cold cathode fluorescent lamp also becomes longer. When the length of the cold cathode fluorescent lamp becomes longer, the cold cathode fluorescent lamp sags due to a weight thereof. When the cold cathode fluorescent lamp sags, the cold cathode fluorescent lamp provides the liquid crystal display panel with non-uniform light. Therefore, the display quality of the liquid crystal display device is deteriorated.

DISCLOSURE OF THE INVENTION

The present invention provides a lamp fixing holder for fixing the lamp. The lamp provides a liquid crystal display panel with light. The lamp fixing holder minimizes the light loss.

The present invention also provides a back light assembly having the lamp fixing holder for fixing a lamp. The lamp fixing holder fixes the lamp, so that the deviation of the luminance and light loss are minimized. Therefore, the luminance is enhanced.

In one aspect of the invention, there is provided a lamp fixing holder for fixing a lamp to a receiving container. The lamp provides a liquid crystal display panel with light. The lamp includes a first portion of a face and a second portion of the face. The light emitted from the first portion of the face advances toward the liquid crystal display panel. The lamp fixing holder comprises a lamp fixing body and a fixing member. The lamp fixing body holds a third portion of the face of the lamp. The second portion includes the third portion. The fixing member fixes the lamp fixing body to the receiving container.

In another aspect, there is provided a lamp fixing holder for fixing a lamp applying light to a liquid crystal display panel. The lamp fixing holder comprises a lamp support ring, a fixing rod, a separation preventing member and a pressing member. The lamp is inserted into the lamp support ring. The fixing rod protrudes from the lamp support ring. The separation preventing member prevents the fixing rod from being separated from a receiving container. The separation preventing member has a first portion and a second portion. The first portion and the second portion protrude from the fixing rod toward the lamp fixing body. The first portion is symmetrical with the second portion with respect to a longitudinal direction of the fixing rod. The pressing member has a third portion and a fourth portion. The third portion and the fourth portion protrude from the portion of the fixing rod toward the separation preventing member. The portion of the fixing rod is disposed between the separation preventing member and the lamp fixing body. The third portion is symmetrical with the fourth portion with respect to, the longitudinal direction of the fixing rod. The pressing member presses the receiving container toward the separation preventing member, when the fixing rod being inserted into the hole of the receiving container.

In further aspect, there is provided a back light assembly comprises a receiving container for receiving a liquid crystal display panel, a lamp for providing the liquid crystal display panel with a light, a lamp fixing body for fixing the lamp, and a fixing member for fixing the lamp fixing body to the receiving container.

The lamp fixing holder according to the present invention fixes the lamp, so that the lamp does not sway. Further, the lamp fixing holder minimizes an amount of light that is shielded by the lamp fixing holder, so that the display quality is enhanced.

BRIEF DESCRIPTION OF THE DRAWINGS

The above and other advantages of the present invention will become readily apparent by reference to the following detailed description when considered in conjunction with the accompanying drawings wherein.

BEST MODE FOR CARRYING OUT THE INVENTION

Embodiment 1

Figure 1:
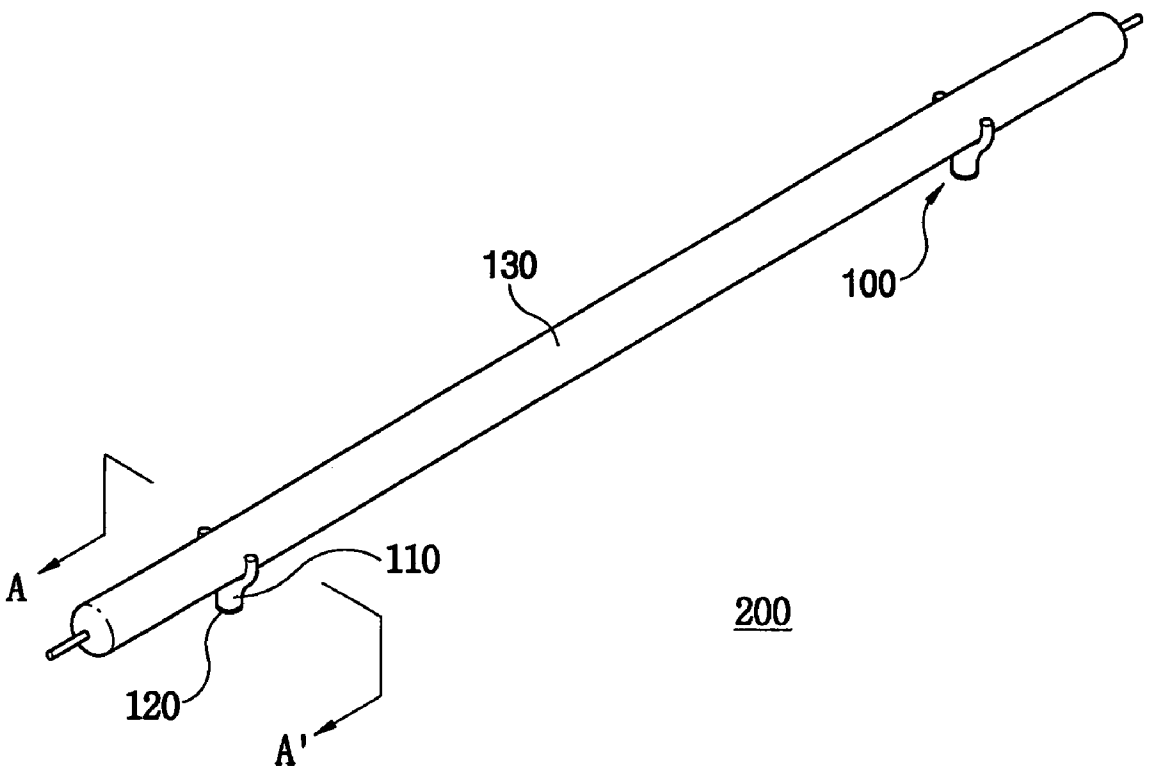
FIG. 1 is a perspective view showing a lamp fixing holder according to a first exemplary embodiment of the present invention.
Figure 2:
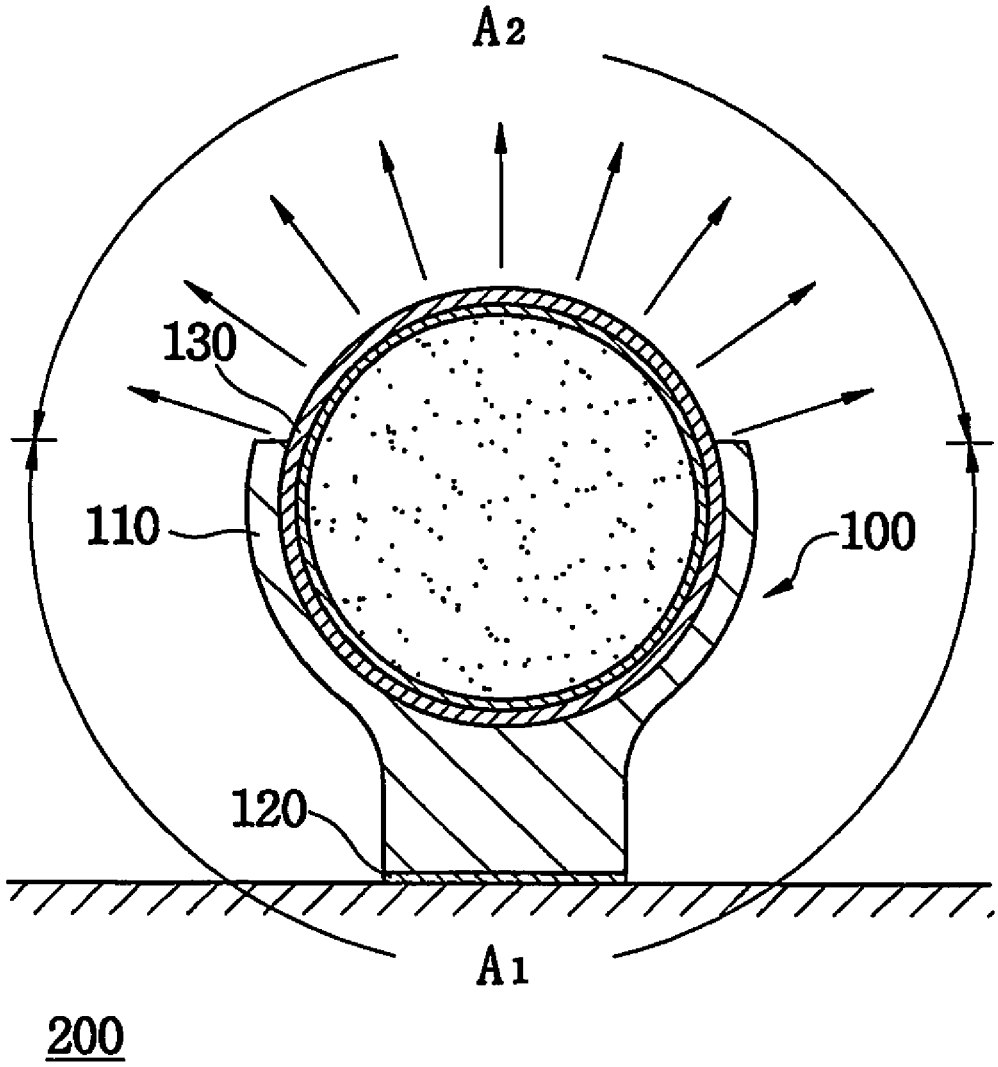
FIG. 2 is a cross-sectional view taken along the line A-A' of FIG. 1.

FIG. 1 is a perspective view showing a lamp fixing holder of the first exemplary embodiment of the present invention and FIG. 2 is a cross-sectional view taken along the line A-A' of FIG. 1.

Referring, to FIGS. 1 and 2, a lamp fixing holder 100 includes a lamp fixing body 110 and a fixing member 120.

The lamp fixing body 110 fixes a lamp 130 having cylindrical shape. The fixing member 120 fixes the lamp fixing body 110 to a receiving container 200.

The lamp fixing body 110 supports the lamp 130, while minimizing the light loss. In order to reduce the light loss, the cross-section of the lamp fixing body 110 has an arc shape. The lamp 130 is inserted into the lamp fixing body 110 of which cross-section has arc shape.

Referring to FIG. 2, the arc of the cross-section of the lamp fixing body 110 is defined a first arc $A_1$ and the remaining arc is defined a second arc $A_2$. The sum of the first arc $A_1$ and the second arc $A_2$ is substantially same as the length of the circumference of the lamp 130.

A ratio of the first arc $A_1$ to the length of the second arc $A_2$ affects the light-using efficiency and the force of connection between the lamp fixing body 110 and the lamp 130.

When the length of the first arc $A_1$ becomes larger and the length of the second arc $A_2$ becomes smaller, the force of connection between the lamp fixing body 110 and the lamp 130 becomes stronger but the light-using efficiency becomes lower.

However, when the length of the first arc $A_1$ becomes smaller and the length of the second arc $A_2$ becomes larger, the force of connection between the lamp fixing body 110 and the lamp 130 becomes weaker but the light-using efficiency becomes higher.

In the embodiment of the present invention, for example, the first arc $A_1$ is longer than (or at least same as) the second arc $A_2$.

The fixing member 120 fixes the lamp fixing body 110 to a receiving container 200. A double-faced adhesive tape or an adhesive agent may be used as the fixing member 120. In this embodiment, for example, the double-faced adhesive tape is used as the fixing member 120.

The double-faced adhesive tape 120 fixes the lamp fixing body 110 to the receiving container 200 so as to prevent the lamp fixing body 110 from swaying of the lamp 130.

Embodiment 2

Figure 3:
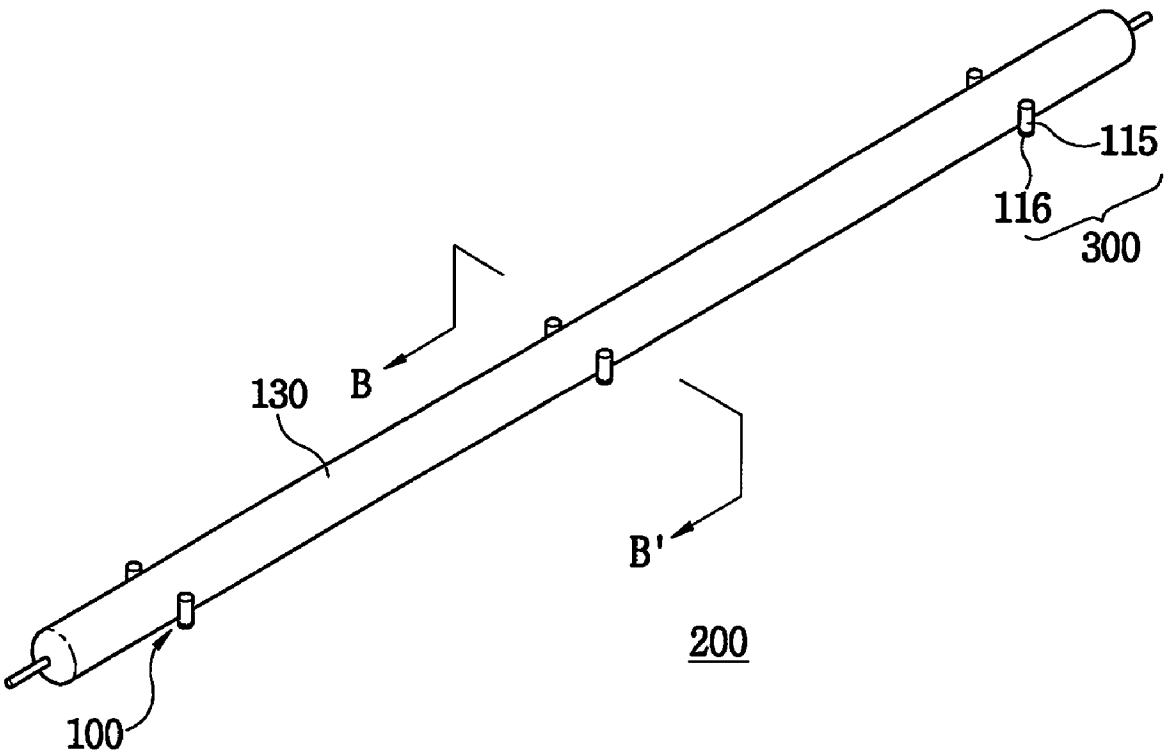
FIG. 3 is a perspective view showing a lamp fixing holder according to a second exemplary embodiment of the present invention.
Figure 4:
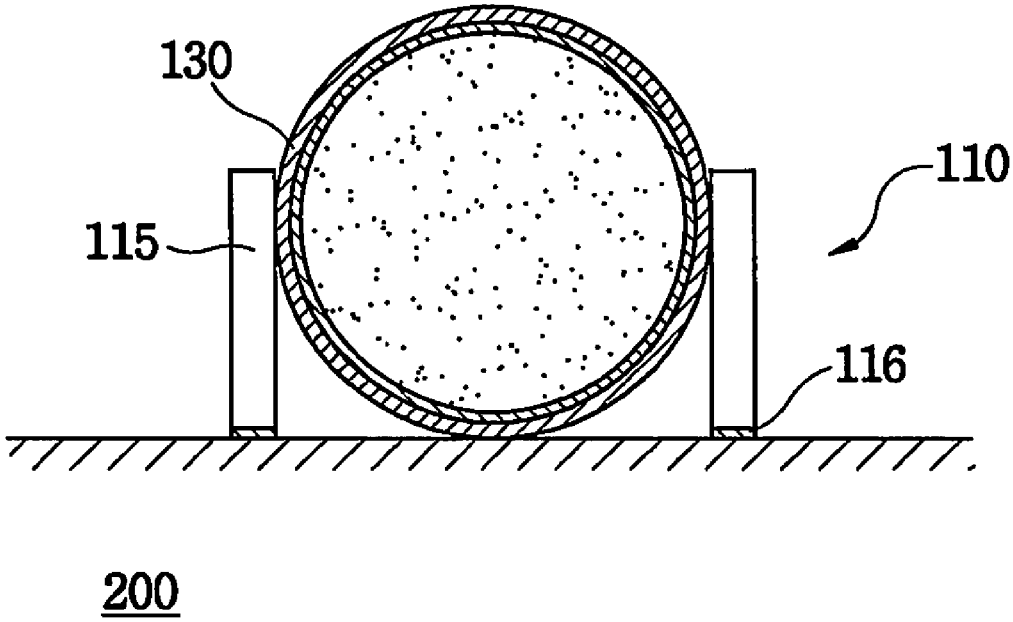
FIG. 4 is a cross-sectional view taken along the line B-B' of FIG. 3.

FIG. 3 is a perspective view showing a lamp fixing holder of the second embodiment of the present invention, and FIG. 4 is a cross-sectional view taken along the line B-B' of FIG. 3.

Referring to FIGS. 3 and 4, a lamp fixing holder 300 includes a pair of lamp fixing bodies 115 and fixing member 116.

The lamp fixing bodies 115 forms a pair. Each of the lamp fixing bodies 115 has a stick-shape. Each of the lamp fixing bodies 115 is spaced apart by a distance that is equal to a diameter of the lamp 130 so as to fix a lamp 130. The lamp fixing bodies 115 are fixed to a receiving container 200 with a fixing member 116. The fixing member 116 may be a double-faced adhesive tape or an adhesive agent.

Embodiment 3

Figure 5:
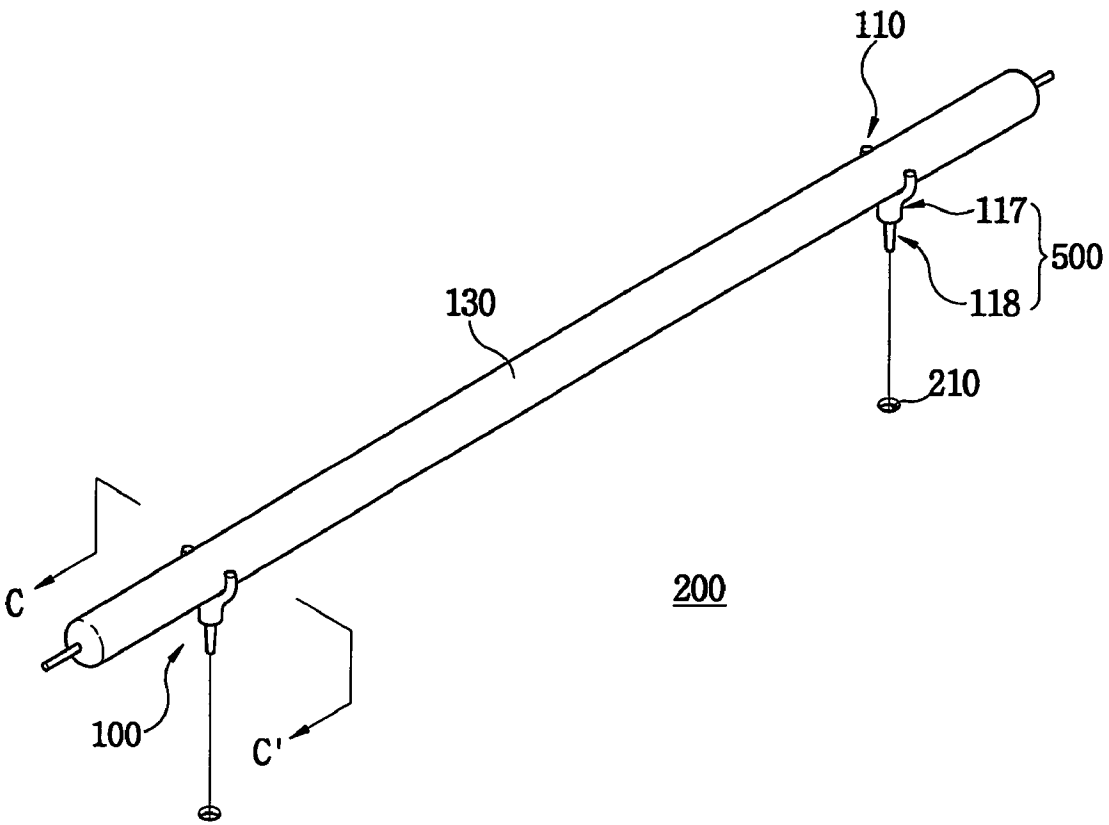
FIG. 5 is a perspective view showing a lamp fixing holder according to a third exemplary embodiment of the present invention.
Figure 6:
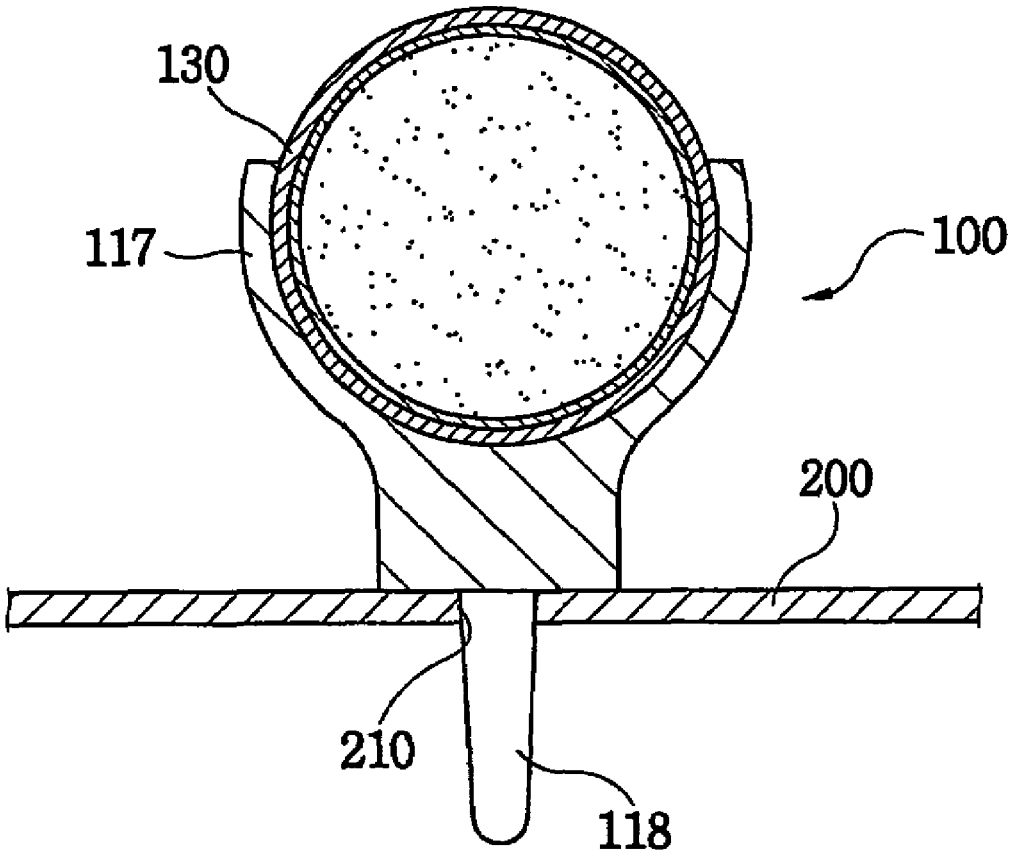
FIG. 6 is a cross-sectional view taken along the line C-C' of FIG. 5.

FIG. 5 is a perspective view showing a lamp fixing holder of the third embodiment of the present invention, and FIG. 6 is a cross-sectional view taken along the line C-C' of FIG. 5.

Referring to FIGS. 5 and 6, a lamp fixing holder 500 includes a lamp fixing body 117 and a fixing rod 118 protruding from the lamp fixing body 117.

The lamp fixing body 117 supports the lamp 130. The fixing rod 118 fixes the lamp fixing body 117 to a receiving container 200.

The lamp fixing body 117 supports the lamp 130, while minimizing the light loss.

In order to minimize the light loss, the cross-section of the lamp fixing body 117 has an arc shape. The lamp 130 having a cylindrical shape is inserted to the lamp fixing body 117.

The fixing rod 118 fixes the lamp fixing body 117 to the receiving container 200. In case that the fixing rod 118 fixes the lamp fixing body 117 to the receiving container 200, the lamp fixing body 117 may be easily detached.

A diameter of the fixing rod 118 is substantially same as the diameter of a hole 210 of the receiving container 200, so that when the fixing rod 118 of the fixing rod 118 is inserted into the hole 210, the lamp fixing holder 500 is fixed strongly.

Embodiment 4

Figure 7:
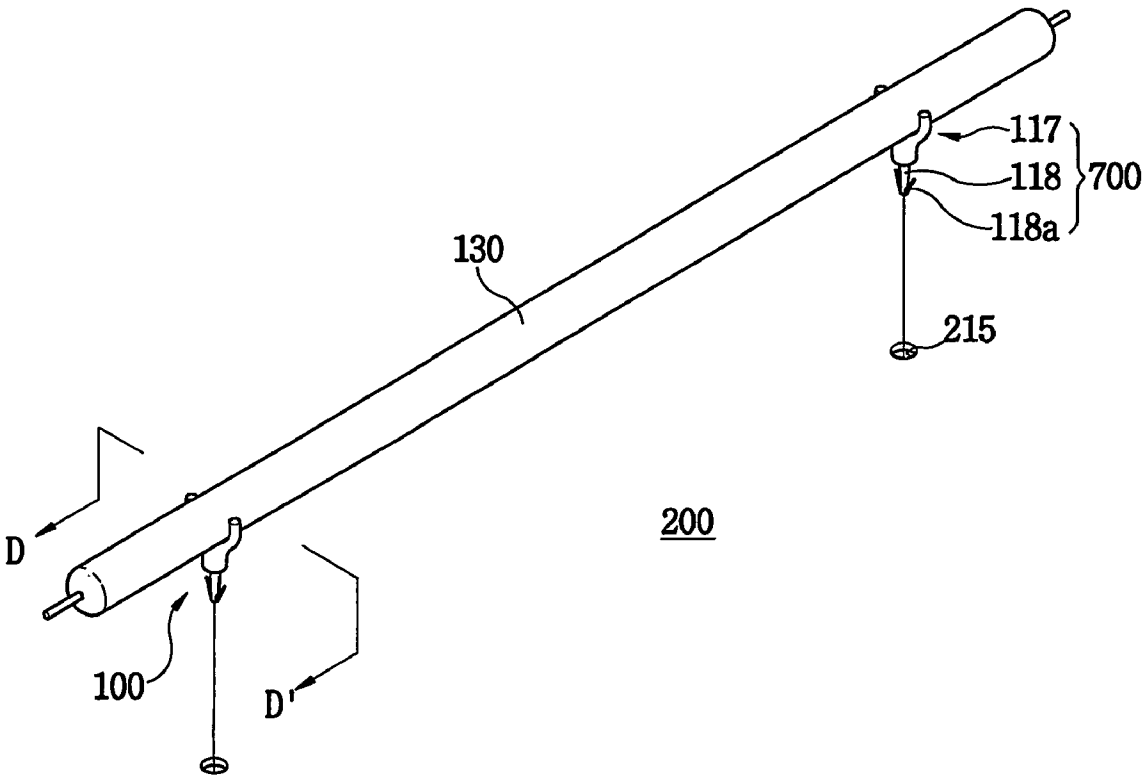
FIG. 7 is a perspective view showing a lamp fixing holder according to a fourth exemplary embodiment of the present invention.
Figure 8:
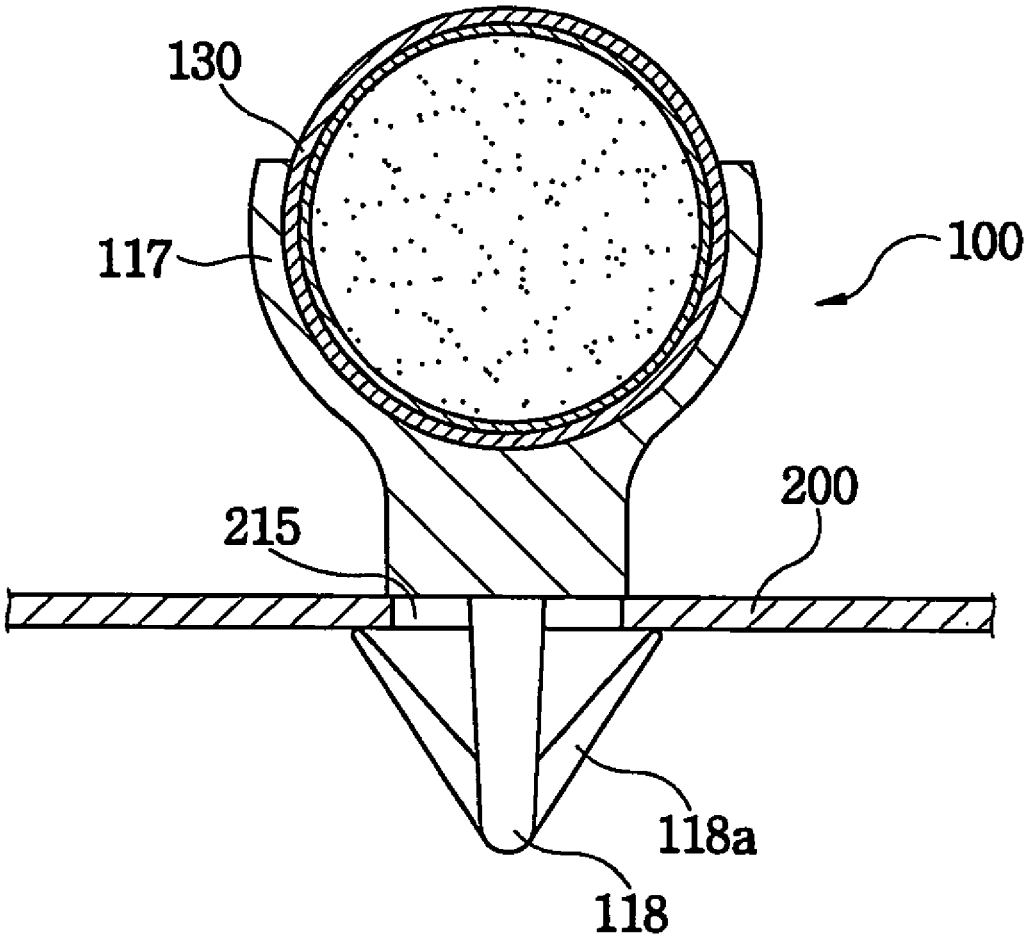
FIG. 8 is a cross-sectional view taken along the line D-D' of FIG. 7.

FIG. 7 is a perspective view showing a lamp fixing holder of the fourth embodiment of the present invention and FIG. 8 is a cross-sectional view taken along the line D-D' of FIG. 7.

Referring to FIGS. 7 and 8, when a fixing rod 118 having separation preventing piece **118*a* is inserted into a hole 215, a fixing rod 118 may not be easily detached from the receiving container 200 by external impact. When the fixing rod 118 is detached from the receiving container 200, the lamp 130 may sway or the lamp 130** may be broken.

The separation preventing piece **118*a* prevents the fixing rod 118 from being detached from the receiving container 200**.

The fixing rod includes a first portion and a second portion.

The separation preventing piece 118*a* protrudes from the fixing rod 118 toward the lamp fixing body 117, so that when the fixing rod 118 is inserted into the hole 215 easily, but the fixing rod 118 is not detached easily from the receiving container 200 when the fixing rod 118 is inserted. Namely, the separation preventing piece 118*a* has a symmetrical arrow-shape with respect to a longitudinal direction of the fixing rod 118.

The separation preventing piece 118*a* includes elastic materials. Therefore, when the fixing rod 118 is inserted into the hole 215 of the receiving container 200, each of the first portion and the second portion of the separation preventing piece 118*a* are transformed.

When the fixing rod 118 is inserted into the hole 215 completely, the separation preventing piece 118*a* is restored to an original state.

A diameter of the hole 215 formed on the receiving container 200 is larger than the diameter of the fixing rod 118, so that the fixing rod 118 having the separation preventing piece 118*a* is inserted into the hole 215 easily. However, when the diameter of the hole 215 is larger than the diameter of the fixing rod 118, the lamp fixing holder 700 is fixed unstably to the receiving container 200.

Therefore, a length of the fixing rod 118 or the length of the separation preventing piece 118*a* is regulated, such that both ends of the separation preventing piece 118*a* make contact with the receiving container 200. Therefore, the lamp fixing holder 700 is fixed to the receiving container 200 stably.

Embodiment 5

Figure 9:
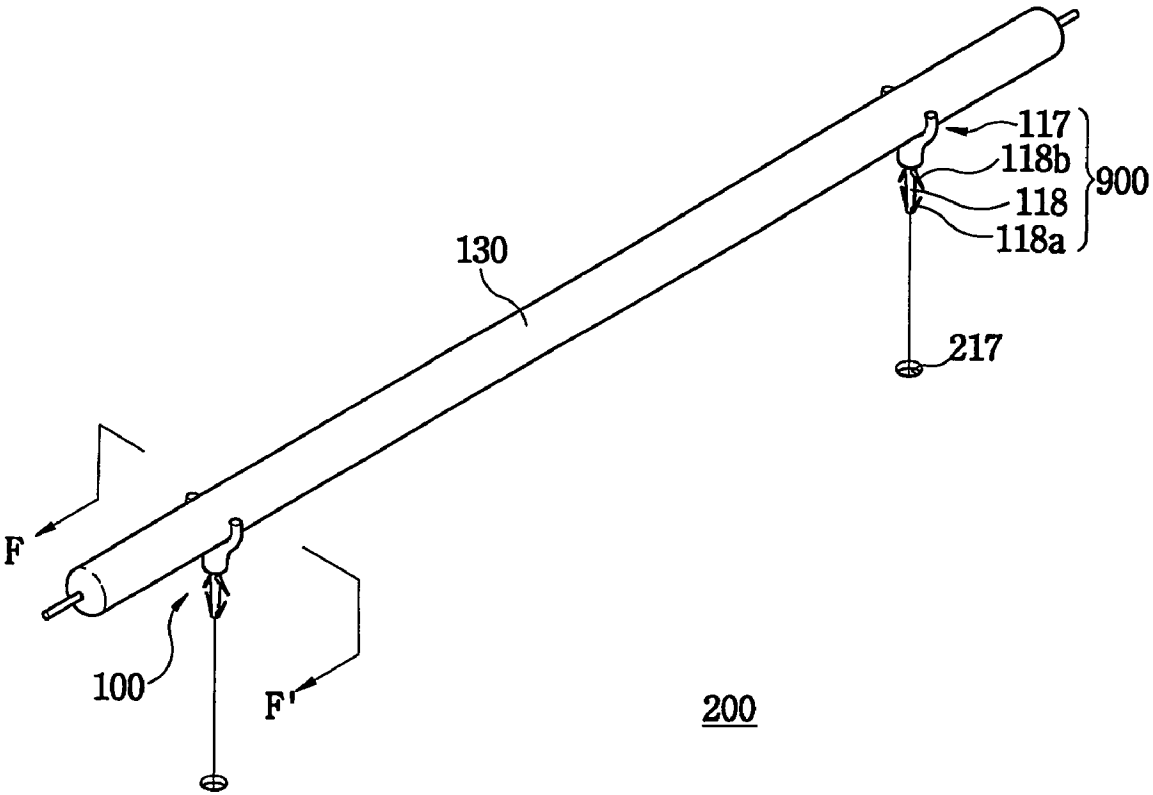
FIG. 9 is a perspective view showing a lamp fixing holder according to a fifth exemplary embodiment of the present invention.
Figure 10:
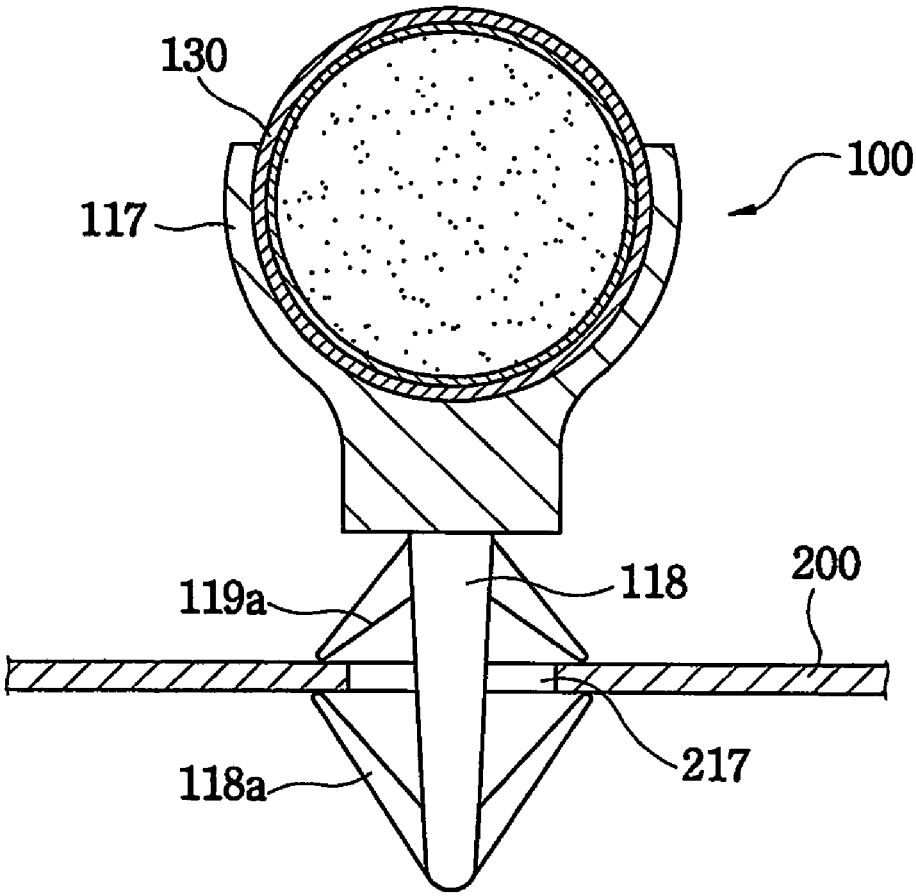
FIG. 10 is a cross-sectional view taken along the line E-E' of FIG. 9.

FIG. 9 is a perspective view showing a lamp fixing holder of the fifth embodiment of the present invention, and FIG. 10 is a cross-sectional view taken along the line E-E' of FIG. 9.

Referring to FIGS. 9 and 10, a separation preventing piece 118*a* and a pressing piece 118*b* protrude from the fixing rod 118.

The separation preventing piece 118*a* includes a first portion and the second portion. The first portion is symmetric with the second portion with respect to a longitudinal direction of the fixing rod 118.

The first portion and the second portion of the separation preventing piece 118*a* protrude from the fixing rod 118 toward a lamp fixing body 117, so that the separation preventing piece 118*a* has an arrow-shape directing downward. Therefore, the fixing rod 118 may be inserted easily.

The pressing piece 118*b* is disposed between the lamp fixing body 117 and the separation preventing piece 118*a*. The pressing piece 118*b* includes a third portion and the fourth portion. The third portion is symmetric with the fourth portion with respect to a longitudinal direction of the fixing rod 118.

The third portion and the fourth portion of the pressing piece 118*b* protrude from the fixing rod 118 toward the separation preventing piece 118*a*, so that the pressing piece 118*b* has an arrow-shape directing upward.

When the fixing rod 118 is inserted into the hole 217 of the receiving container 200, the pressing piece 118*b* presses the receiving container 200, so that both ends of the first portion and the second portion of the separation preventing piece 118*a* makes contact with the receiving container 200.

Therefore, the separation preventing piece 118*a* and the pressing piece 118*b* fix the lamp fixing holder 900 to the receiving container 200 stably.

The separation preventing piece 118*a* includes elastic materials. Therefore, when the fixing rod 118 is inserted into the hole 215 of the receiving container 200, each of the first portion and the second portion of the separation preventing piece 118*a* are transformed.

When the fixing rod 118 is inserted into the hole 215 completely, the separation preventing piece 118*a* is restored to an original state.

Embodiment 6

Figure 11:
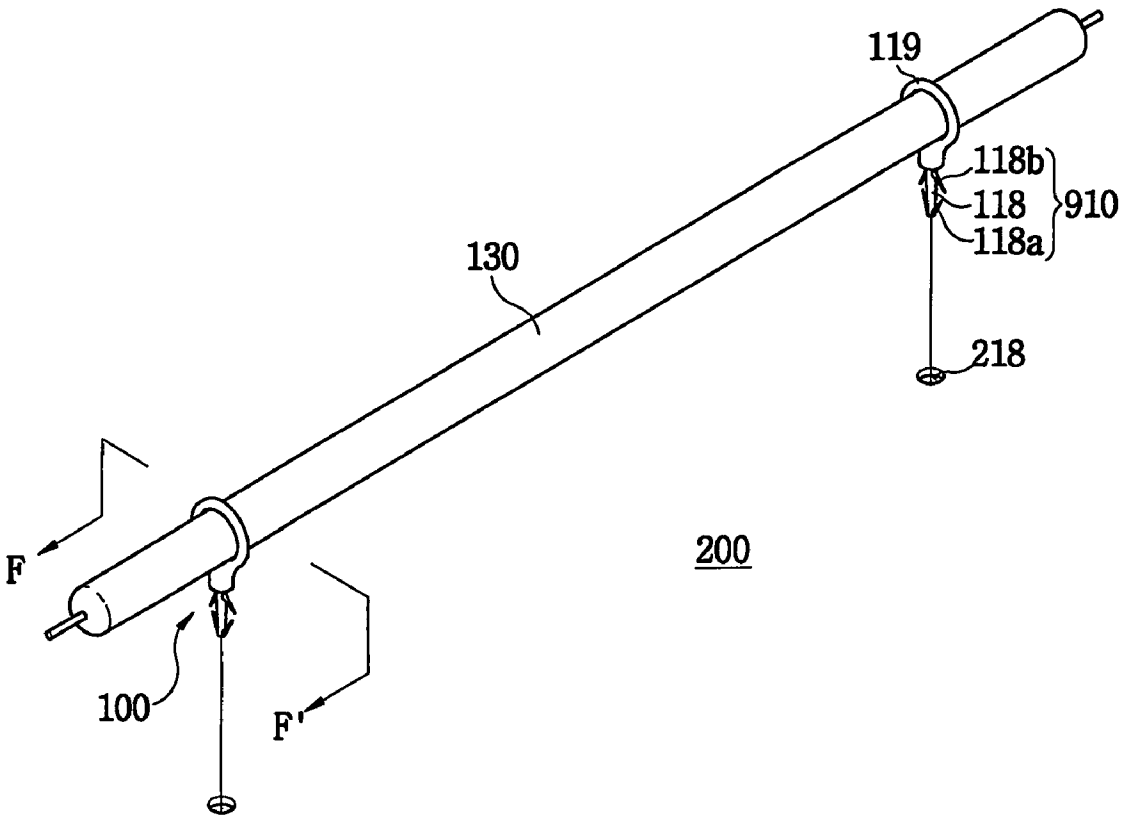
FIG. 11 is a perspective view showing a lamp fixing holder according to a sixth exemplary embodiment of the present invention.
Figure 12:
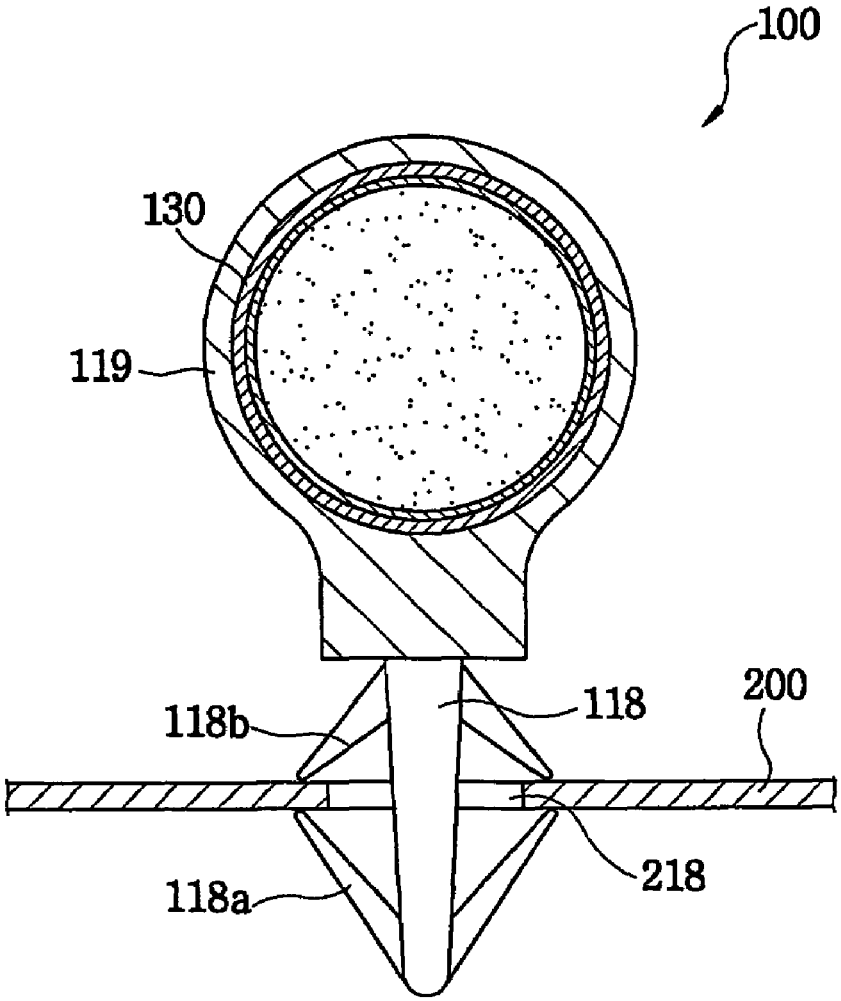
FIG. 12 is a cross-sectional view taken along the line F-F' of FIG. 11.

FIG. 11 is a perspective view showing a lamp fixing holder of the sixth embodiment of the present invention and FIG. 12 is a cross-sectional view taken along the line F-F' of FIG. 11.

Referring to FIGS. 11 and 12, lamp fixing holder 910 includes a lamp support ring 119, a fixing rod 118, a separation preventing piece 118*a* and a pressing piece 118*b*.

The lamp support ring 119 has a ring shape to grip a lamp 130 having a cylindrical shape.

The separation preventing piece 118*a* includes a first portion and the second portion. The first portion is symmetric with the second portion with respect to a longitudinal direction of the fixing rod 118.

The first portion and the second portion of the separation preventing piece 118*a* protrude from the fixing rod 118 toward a lamp fixing body 117, so that the separation preventing piece 118*a* has an arrow-shape directing downward. Therefore, the fixing rod 118 may be inserted easily.

The fixing rod 118 protrudes from the lamp support ring 119. The fixing rod 118 is inserted into a hole 218 of a receiving container 200.

The pressing piece 118*b* is disposed between the lamp fixing body 117 and the separation preventing piece 118*a*. The pressing piece 118*b* includes a third portion and the fourth portion. The third portion is symmetric with the fourth portion with respect to a longitudinal direction of the fixing rod 118.

The third portion and the fourth portion of the pressing piece 118*b* protrude from the fixing rod 118 toward the separation preventing piece 118*a*, so that the pressing piece 118*b* has an arrow-shape directing upward.

When the fixing rod 118 is inserted into the hole 217 of the receiving container 200, the pressing piece 118*b* presses the receiving container 200, so that both ends of the first portion and the second portion of the separation preventing piece 118*a* makes contact with the receiving container 200.

Therefore, the separation preventing piece 118*a* and the pressing piece 118*b* fix the lamp fixing holder 900 to the receiving container 200 stably.

The separation preventing piece 118*a* includes elastic materials. Therefore, when the fixing rod 118 is inserted into the hole 215 of the receiving container 200, each of the first portion and the second portion of the separation preventing piece 118*a* are transformed.

When the fixing rod 118 is inserted into the hole 215 completely, the separation preventing piece 118*a* is restored to an original state.

Figure 13:
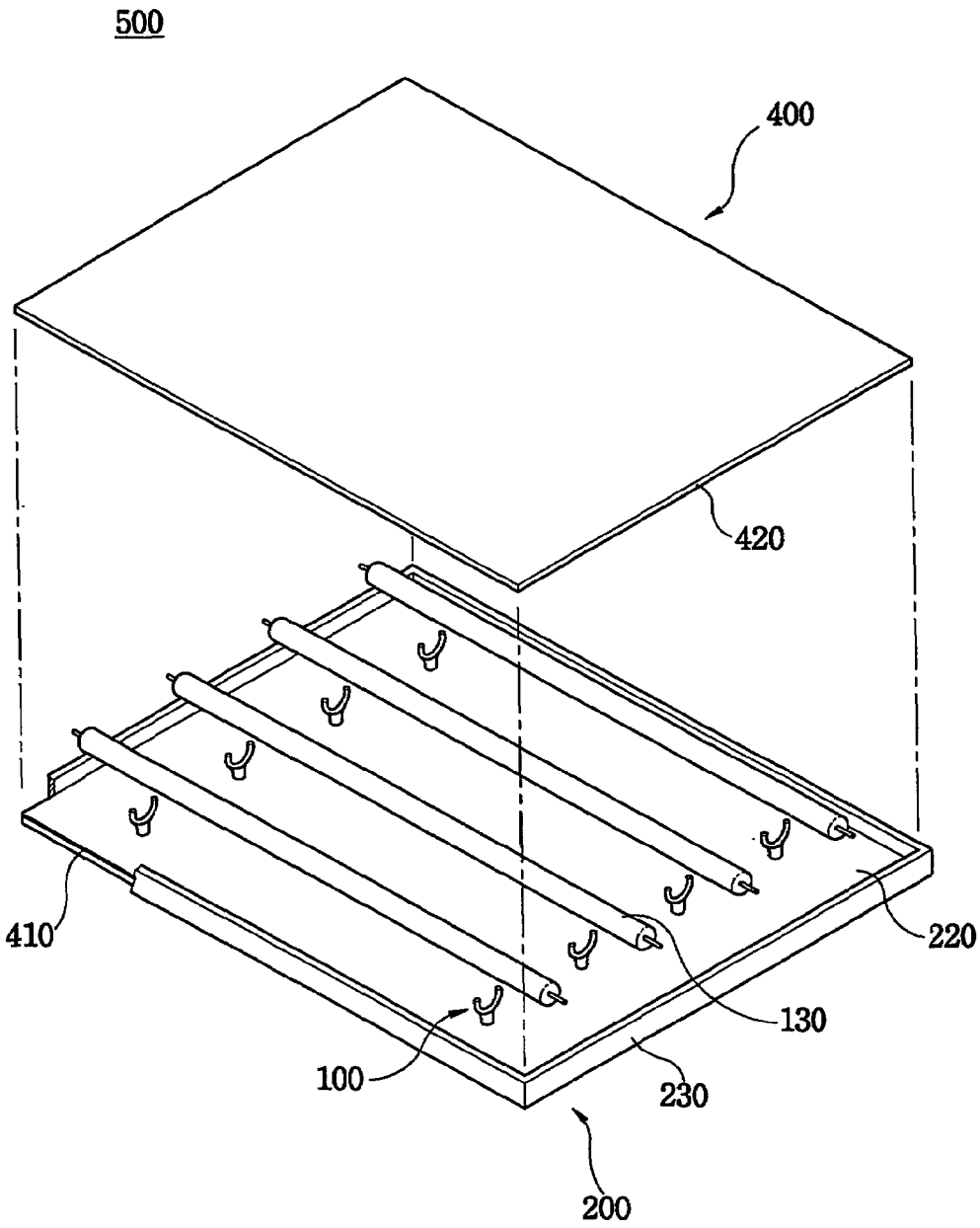
FIG. 13 is a perspective view showing a back light assembly having one of a lamp fixing holder of the present invention.

FIG. 13 is a perspective view of back light assembly having one of a lamp fixing holder of the present invention.

Referring to FIG. 13, a back light assembly 500 includes a receiving container 200, a lamp 130, a lamp fixing holder 100 and back light unit 400.

The receiving container 200 has bottom face 220 having a predetermined area, and a plurality of sidewalls 230 elongated vertically from the edge of the bottom face 230 to form a receiving space. The receiving container 200 is combined with a liquid crystal display panel.

A plurality of lamps 130 is arranged parallel with each other on the bottom face 220 of the receiving container 200.

A lamp fixing holder 100 fixed on the bottom face 220 fixes the lamp 130. In FIG. 13, the lamp fixing holder 100 of the first embodiment of FIGS. 1 and 2 fixes the lamp 130. However, the lamp fixing holder 100 may be one of the lamp fixing holders of the second embodiment to the sixth embodiment.

The back light unit 400 includes a reflector 410 and diffusion plate 420.

The reflector 410 is disposed between the bottom face 220 of the container 200 and the lamps 130 so as to reflect the light advancing toward the bottom face 220. The reflector 410 enhances the light using efficiency.

The diffusion plate 420 makes the luminance of the light generated by the lamps 130 uniform, so that high quality display is achieved.

INDUSTRIAL APPLICABILITY

According to present invention, a lamp fixing holder for fixing a lamp that supplies a liquid crystal display device with light, prevents the lamp from swaying, while minimizing the light loss.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

The invention claimed is:

1. A lamp fixing holder for fixing a lamp to a receiving containers, the lamp providing a liquid crystal display panel with light, the lamp including a first portion of a face and a second portion of the face, the light emitted from the first portion of the face advancing toward the liquid crystal display panel, the lamp fixing holder comprising;

a lamp fixing body comprising a continuous arcuate top surface for holding a third portion of the face of the lamp, the second portion including the third portion, wherein the top surface of the lamp fixing body continuously contacts a first arc of a circumference of the lamp having a cylindrical shape, the first arc being longer than a second arc, a sum of the first arc and the second arc being equal to the circumference of the lamp; and a fixing member for fixing the lamp fixing body to the receiving container.

2. The lamp fixing holder of claim 1, wherein the first arc corresponds to the circumference of the lamp.

3. The lamp fixing holder of claim 1, wherein the fixing member includes a double-faced adhesive tape.

4. The lamp fixing holder of claim 1, wherein the fixing member includes a fixing rod, the fixing rod protruding from the lamp fixing body, and the fixing rod being inserted into a hole formed on the receiving container.

5. The lamp fixing holder of claim 1, wherein the fixing member includes:

a fixing rod protruding from the lamp fixing body, the fixing rod being inserted into a hole of the receiving container; and a separation preventing member for preventing the fixing rod from being separated from the receiving container, the separation preventing member having a first portion and a second portion, the first portion and the second portion protruding from the fixing rod toward the lamp fixing body, the first portion being symmetrical with the second portion with respect to a longitudinal direction of the fixing rod.

6. The lamp fixing holder of claim 5, wherein both of ends of the first portion and the second portion makes contact with the receiving container when the fixing rod being inserted into the hole of the receiving container.

7. The lamp fixing holder of claim 5, further comprises a pressing member having a third portion and a fourth portion, the third portion and the fourth portion protruding from the a portion of the fixing rod toward the separation preventing member, the portion of the fixing rod being disposed between the separation preventing member and the lamp fixing body, the third portion being symmetrical with the fourth portion with respect to the longitudinal direction of the fixing rod, the pressing member pressing the receiving container toward the separation preventing member when the fixing rod being inserted into the hole of the receiving container.

8. A lamp fixing holder for fixing a lamp applying light to a liquid crystal display panel, comprising:

a lamp support ring, comprising a continuous arcuate inner surface for holding the lamp having a cylindrical shape inserted into the lamp support ring, wherein the inner surface of the lamp support ring continuously contacts a circumference of the lamp;

a fixing rod protruding from the lamp support ring;

a separation preventing member for preventing the fixing rod from being separated from a receiving container, the separation preventing member having a first portion and a second portion, the first portion and the second portion protruding from the fixing rod toward the lamp fixing body, the first portion being symmetrical with the second portion with respect to a longitudinal direction of the fixing rod; and a pressing member having a third portion and a fourth portion, the third portion and the fourth portion protruding from the a portion of the fixing rod toward the separation preventing member, the portion of the fixing rod being disposed between the separation preventing member and the lamp fixing body, the third portion being symmetrical with the fourth portion with respect to the longitudinal direction of the fixing rod, the pressing member pressing the receiving container toward the separation preventing member when the fixing rod being inserted into the hole of the receiving container.

9. A back light assembly comprising:

a receiving container for receiving a liquid crystal display panel;

a lamp for providing the liquid crystal display panel with a light;

a lamp fixing body for fixing the lamp, wherein the lamp fixing body comprises a continuous arcuate top surface for holding the lamp, wherein the top surface of the lamp fixing body continuously contacts a first arc of a circumference of the lamp having a cylindrical shape, the first arc being longer than a second arc, a sum of the first arc and the second arc being equal to the circumference of the lamp; and a fixing member for fixing the lamp fixing body to the receiving container.

10. The back light assembly of claim 9, wherein the lamp includes a first portion of a face and a second portion of the face, the light emitted from the first portion of the face advancing toward the liquid crystal display panel, the lamp fixing body holding a third portion of the face of the lamp, the second portion including the third portion.

11. The back light assembly of claim 9, wherein the lamp fixing body enwraps a first arc of a circumference of the lamp having cylindrical shape, the first arc being longer than a second arc, a sum of the first arc and the second arc being equal to the circumference of the lamp.

12. The back light assembly of claim 9, wherein the fixing member includes a double-faced adhesive tape.

13. The back light assembly of claim 9, wherein the fixing member includes:

a fixing rod protruding from the lamp fixing body, the fixing rod being inserted into a hole of the receiving container; and a separation preventing member for preventing the fixing rod from being separated from the receiving container, the separation preventing member having a first portion and a second portion, the first portion and the second portion protruding from the fixing rod toward the lamp fixing body, the first portion being symmetrical with the second portion with respect to a longitudinal direction of the fixing rod.

14. The back light assembly of claim 13, wherein both of ends of the first portion and the second portion makes contact with the receiving container when the fixing rod being inserted into the hole of the receiving container.

15. The back light assembly of claim 13, further comprises a pressing member having a third portion and a fourth portion, the third portion and the fourth portion protruding from the a portion of the fixing rod toward the separation preventing member, the portion of the fixing rod being disposed between the separation preventing member and the lamp fixing body, the third portion being symmetrical with the fourth portion with respect to the longitudinal direction of the fixing rod, the pressing member pressing the receiving container toward the separation preventing member when the fixing rod being inserted into the hole of the receiving container.

16. The back light assembly of claim 9, wherein the first arc corresponds to the circumference of the lamp.

* * * * *